United States Patent [19]

Ross

[11] 4,130,279

[45] Dec. 19, 1978

[54] INDOOR GOLF

[76] Inventor: Samuel C. Ross, 510 S. 8th West, Brigham City, Utah 84302

[21] Appl. No.: 817,558

[22] Filed: Jul. 21, 1977

[51] Int. Cl.[2] ..... A63F 7/06

[52] U.S. Cl. ..... 273/87.2; 273/67 B

[58] Field of Search ..... 273/87, 87.2, 87.4, 273/129 R, 129 A, 129 B, 126 R, 126 A, 83, 67 R, 67 B

[56] References Cited

U.S. PATENT DOCUMENTS

| | | | |
|---|---|---|---|
| 1,567,765 | 12/1925 | Spaulding | 273/83 |
| 1,782,931 | 11/1930 | Lilley | 273/87.2 |
| 3,171,657 | 3/1965 | Strang | 273/129 A |
| 3,755,820 | 9/1972 | Petrusek | 272/76 |
| 3,907,294 | 9/1975 | Breslow | 273/126 R |
| 3,990,699 | 11/1976 | Urmston | 273/67 B |

FOREIGN PATENT DOCUMENTS

| | | | |
|---|---|---|---|
| 857181 | 12/1970 | Canada | 273/67 B |
| 345960 | 3/1931 | United Kingdom | 273/126 R |

*Primary Examiner*—Richard T. Stouffer
*Assistant Examiner*—Harry G. Strappello
*Attorney, Agent, or Firm*—Criddle, Thorpe & Western

[57] ABSTRACT

A game for indoor or outdoor use comprising a hollowed out hand held club having a notch on top for a thumb hold. A series of markers numbered from one to eighteen are placed about the legs of furniture. The object is to hit a golf ball with the hand held club until it strikes a leg in sequenced number. The player having the lowest number of strokes wins.

7 Claims, 4 Drawing Figures

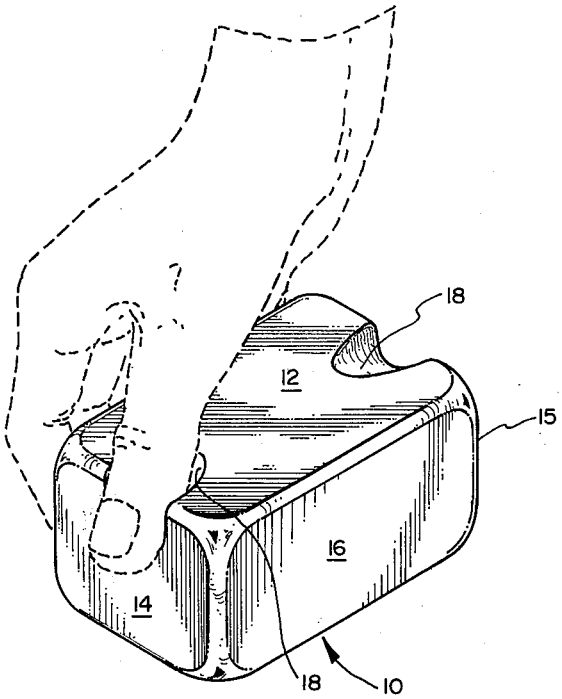
FIG. 1
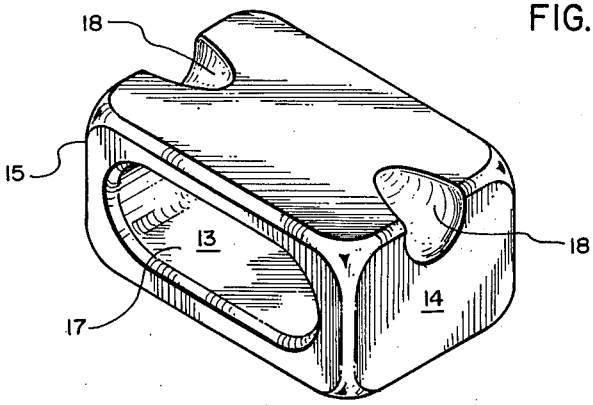
FIG. 2
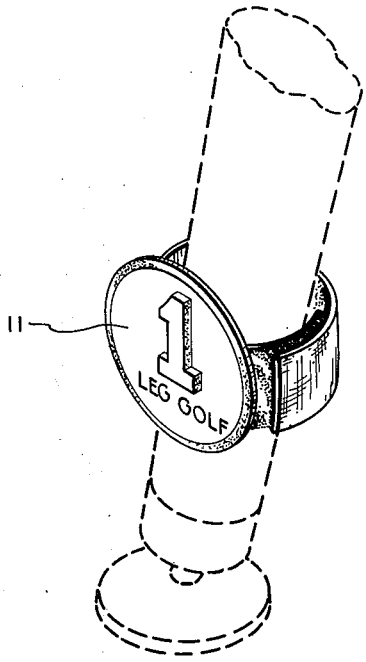
FIG. 3
19
SCORE CARD
| NAME | 1 | 2 | 3 | 4 | 5 | 6 | 7 | 8 | 9 | 10 | 11 | 12 | 13 | 14 | 15 | 16 | 17 | 18 | TOTAL |
|---|---|---|---|---|---|---|---|---|---|---|---|---|---|---|---|---|---|---|---|
| 1 | | | | | | | | | | | | | | | | | | | |
| 2 | | | | | | | | | | | | | | | | | | | |
| 3 | | | | | | | | | | | | | | | | | | | |
| 4 | | | | | | | | | | | | | | | | | | | |
SCOREKEEPER LEGGOLF GAME Nº
FIG. 4

INDOOR GOLF

BACKGROUND OF THE INVENTION

There are many games on the market that require finger dexterity and accuracy. However, it is not believed that there is on the market any game for either indoor or outdoor use which may be played with a hand held club or block having no handle and requiring a different kind of dexterity than regular golf.

DESCRIPTION OF THE DRAWINGS AND OBJECTS OF THE INVENTION

FIG. 1 is a perspective view of a typical club showing the thumb position and face.

FIG. 2 is a back view of the club showing the finger cavity.

FIG. 3 is a marker which can be placed around the leg of a piece of furniture.

FIG. 4 is a typical score card

It is an object of this invention to provide a game for indoor or outdoor use. It is also an object of this invention to provide a game that can be played by people of all ages.

A further object of this invention is to provide a game that can be played indoors in any kind of weather.

These and other objects will become more apparent from the following description of the drawings and suggested rules of the game.

DRAWINGS AND DESCRIPTION OF THE INVENTION

There is shown in FIGS. 1 to 3, a complete embodiment of the invention comprising a block 10, and an indicator 11, FIG. 4 shows a typical score card and method of keeping score.

Block or hand club 10 is preferably rectangular in shape having five enclosed sides, a top 12, a bottom 13, two sides 14 and 15, and more importantly, a face 16. The block contains a cavity 17, into which the fingers, except the thumb is inserted. There is a thumb indentation 18, in top 12, for ease in holding. The kit is complete with indicators 11, of which there are usually eighteen. Of course, golf balls are an integral part of the game as is scorecard 19.

Any item can be used for a target such as chairs, beds, tables or other pieces of furniture. A chair or other pieces of furniture can have two or more indicators on it. The targets are numbered one to nine or one to eighteen as in regular golf. The number of players is only limited by the number of blocks. For speed of playing it is recommended that not more than four players play at a time.

The ball is hit by wrist action by the block or hand club 10. Regular golf balls may be used which may be the same or of different colors and/or numbers.

Every game may be different by moving the indicators to different positions. As in golf, the player with the lowest score wins the game. Therefore, on scorecard 19, is recorded the number of strokes taken to hit each target marked by an indicator, 11. Depending upon the complexity of the course the par value for each indicator may be predetermined. For example if the indicators are close together, par value could be two strokes for each indicator or 36 for the game.

As previously indicated the blocks or clubs have thumb grooves at the top at each end for right or left handed players and the club is hollowed out for the remaining fingers.

Preferably the striking action is with a twist of the wrist only. No arm swing is required and preferably not permitted. The golf ball is always struck so as to roll and not fly up into the air.

The indicators are adjustable and may thus fit any size of furniture leg. The indicators may be attached to the legs by means of a strap made of a synthetic material which adheres when pressed together such as is sold under the trademark VELCRO, a leather strap, elastic means or a string on a cord. As previously noted the legs may be arranged any way in the room. The position of the legs, or other natural obstacles, may not be moved during a game.

While not being strictly limited to the following a preferrable set of rules for playing the game follows.

Place the indicators on 18 legs, or 9 legs as desired. Any design or pattern may be used such as zig zag, crisscross, square, circular, or back and forth across the room.

The indicators should be placed a few inches above the floor so the ball can hit the legs and not the indicators.

The game may be played as singles or with partners combining their scores. Because of the rapidity of play one game is 18 legs but a tournament, as in regular golf, is four games or 72 legs.

The players turn may be determined in any way such as by drawing numbers or by alternating if doubles are being played. In singles players turns may be determined by alphebetical order of their first and last names.

Each player will select a block or club by its number i.e. one through four, and/or color. Preferrably, the balls will be numbered or colored and each player will use the ball the same number and/or color as the club.

As each game is completed the first player from the completed game moves to last place and each player moves up one number. Since the clubs and balls are preferrably numbered and/or colored, they are traded to match the new positions.

A scorekeeper is selected such as the one holding the number one position. The number of strokes taken to hit each leg are recorded.

All players start from a common point such as a doorway, corner of the room, etc. The first player takes as many strokes as needed to contact the first leg. The player then picks up the ball and waits for each following player to hit the first leg.

After all players have hit the first leg, they then all start from a common point one club length away from leg one and they then continue to shoot in turn for leg two and so on up to leg 18. As already stated, a ball must always roll and never be hit into the air.

A ball may be moved or touched only when it is closer than one club length from any obstacle. The ball may then be moved only one club length from the obstacle such as a piece of furniture or a wall.

When playing inside there are no boundaries. A ball may be bounced off any wall or other obstacle.

A ball that rolls out of an open doorway, or down a stairway may be moved to a point in the doorway or at the top of the stairway.

If a ball stops in a hole or under a low piece of furniture in an unplayable position, it may be moved one club length away from the barrier. A low piece of furniture is one with the bottom lower than one club length to the floor.

From the above it is evident that only one player's ball will be on the floor at any one time.

As with any golf game there are penalties for infractions of the rules. For example, one stroke may be added for committing any of the following violations; (1) changing position of any leg or obstacle, (2) using arm swing, (3) hitting or bouncing the ball into the air, (4) scorecard not initialed by scorekeeper, (5) not starting from the same point by each leg as all other players, (6) touching or moving the ball, except when the ball is too close to an obstacle.

Outdoor rules may be similar; however, the playing area should not be more than 100 feet square. Starting at a point one club length from leg or stake 18, the player shoots for leg or stake 1. A ball out of bounds may be moved to the point where it went out with no penalty.

The block or clubs are preferrably made out of wood, however other materials such as high impact plastics or metals may be used. The indicators may be made out of plastic, metal, cardboard, cloth, or any other suitable material with the attaching means being described as above.

The term "furniture leg" as used herein also includes other objects about which an indicator may be fastened including stake or pegs outdoors and any other objects indoors or outdoors.

Although the invention as has been described is deemed to be that which would form a preferred embodiment of the invention, it is recognized that departures may be made therefrom without departing from the scope of the invention which is not to be limited to the details disclosed but is to be accorded the full scope of the claims so as to include any and all equivalent devices.

I claim:

1. A game comprising rectangular shaped hollow clubs having no projections extending beyond the peripheral rectangular configuration thereof and being open on one side for insertion of the fingers, the top of said club having indentations for thumbs; a series of sequentially numbered indicators detachably connectable to a furniture leg in numerical order, golf balls to go with the clubs, and a scorecard.

2. A game according to claim 1, wherein the clubs are wider than they are high and wherein the width of the club comfortably fits the inserted fingers of the hand.

3. A game according to claim 2, wherein the indicators each have means thereon for removeably attaching said indicators to furniture legs.

4. A game according to claim 3 wherein the indicators are made from a member selected from the group consisting of plastic, metal, cardboard, and cloth.

5. A game according to claim 2, wherein the clubs are of different colors, numbers or colors and numbers combined.

6. A game according to claim 5, wherein the golf balls are the same color, number, or colors and numbers combined as the clubs.

7. A method of playing a golf game with rectangular shaped hollow clubs having a base and no projections extending beyond the peripheral rectangular configuration thereof which comprises sequentially numbering furniture legs with an indicator, placing the fingers in the hollow club and the thumb in an indentation at the top of the club, striking a golf ball with the face of the club until the ball touches the first sequentially numbered furniture leg and then proceeding to the next sequentially numbered leg until all numbered legs have been contacted and then computing the total number of strokes taken to strike all of the legs.

* * * * *